US005169570A

United States Patent [19]

Sayers et al.

[11] Patent Number: 5,169,570

[45] Date of Patent: Dec. 8, 1992

[54] JOINTING OF FABRIC ENDS

[75] Inventors: Ian C. Sayers, Ribchester, United Kingdom; Leonard R. Lefkowitz, Latham, N.Y.

[73] Assignee: Scapa Group PLC, Blackburn, England

[21] Appl. No.: 520,761

[22] Filed: May 9, 1990

[30] Foreign Application Priority Data

May 13, 1989 [GB] United Kingdom ..... 8911033

[51] Int. Cl.[5] ..... B29C 35/08; B28B 7/18

[52] U.S. Cl. ..... 264/22; 264/154; 264/257; 264/258; 264/273

[58] Field of Search ..... 139/383 A, 383 AA; 264/154, 22, 257, 258, 273

[56] References Cited

U.S. PATENT DOCUMENTS

| | | | |
|---|---|---|---|
| 3,301,931 | 1/1967 | Morin | 264/273 |
| 3,546,330 | 12/1970 | Thompson | 264/258 |
| 4,095,622 | 6/1978 | MacBean | 139/383 AA |
| 4,364,421 | 12/1982 | Martin | 139/383 A |
| 4,457,817 | 7/1984 | Bobeth et al. | 264/22 |
| 4,470,409 | 4/1988 | Lefkowitz . | |

*Primary Examiner*—Hubert C. Lorin
*Assistant Examiner*—A. Ortiz
*Attorney, Agent, or Firm*—Fleit, Jacobson, Cohn, Price, Holman & Stern

[57] ABSTRACT

A method of joining the ends of a papermakers fabric wherein machine direction yarns are fringed out at the fabric ends, yarn ends being laid across a pinned plate, and yarn ends being cut back so as partially to overlie the plate. Those yarns which extend across the plate are folded back to form loops beyond the edge of the plate and a thermoplastics matrix material is applied to the plate. The matrix material is made fluid by heating and, on subsequent cooling, forms an apertured end to the fabric which presents side-by-side, outwardly extending loops. The loops at the respective fabric ends may be interdigited to receive a pintle wire, thus to bring the fabric into endless form. A variation of the method wherein a reticulate, premoulded seam element is engaged with the pinned plate for attachment to machine direction yarns of the fabric on melting of the matrix material, the seam element including axially aligned tunnels at a free edge thereof for cooperation with similar formations at an opposed fabric end and to receive a pintle wire.

5 Claims, 2 Drawing Sheets

JOINTING OF FABRIC ENDS

FIELD OF THE INVENTION

The invention concerns the jointing of fabric ends, and has particular, though not exclusive, reference to the joining together of the opposed ends of a papermakers or like industrial fabric so as to bring the same into the form of an endles band.

BACKGROUND OF THE INVENTION

For many years considerable attention has been directed to the provision of seam forming elements at the respective ends of a papermakers' fabric whereby said ends might be securely and uniformly joined in such manner that the permeability in the seam region is not materially different from that of the body of the fabric.

Originally seaming was effected by sewing or otherwise securing a tape carrying laterally extending loops to each of the respective fabric ends, the loops at the respective ends being interdigitated and a pintle wire being introduced into the tunnel formed by the interdigitated loops to hold the ends together.

Another known procedure, see for example GB-A-1348098, involved the introduction of the individual turns of a helical coil between adjacent warp yarns in a weft-free zone of a single layer woven fabric in closely spaced disposition relative to the fabric end and the folding of the free fabric end about such turns thus to make captive the coil relative to the fabric, the free fabric end being sewn or otherwise secured to the body of the fabric.

Another well practised procedure is to "weave back" free warp ends into the body of the fabric and in so doing form loops from the individual warp yarns, the loop-forming warp yarns each being folded back into alignment with an adjacent cut-back warp yarn.

SUMMARY OF THE INVENTION

The object of the present invention is to provide a further method of forming loops or loop-like structures at a fabric end, whether of woven construction or otherwise for cooperation with a complementary formation at an opposed fabric end and to receive a pintle wire into engagement therewith.

According to the present invention there is proposed a method of providing a jointing means at a fabric end for cooperative engagement with a complementary jointing means at another fabric end in effecting a seam between the said fabric ends thus to form an endless band, the fabric ends including monofilament yarns extending in the movement direction of the endless band, the method comprising the steps of providing protruding side-by-side free yarn ends extending in the said movement direction at the said fabric end, locating said protruding yarn ends relative to a mould plate for engagement with or by a matrix material applied to the said plate, providing a loop-forming material to overlie the mould plate and to extend outwardly therefrom at that side thereof remote from the body of the fabric thereat to define loops, and effecting polymerisation/-curing or melting/ solidification of the matrix material, as appropriate, thereby to embed the free yarn ends and loop forming material therein.

According to one aspect of the invention, the loop-forming material comprises the remote ends of the respective free yarn ends, said free yarn ends being folded back to define the aforesaid loops with the extremities of the said free yarn ends positioned for embedment in the matrix material.

According to another aspect of the invention, the loop forming material comprises a pre-formed element having loops extending from an edge thereof, the body of the element being embedded in the matrix material. Preferably, the body of the element is apertured and the free yarn ends are threaded through successive ones of the said apertures in a direction corresponding to the longitudinal direction of the belt.

Preferably, the method includes the further step of providing upstanding pins to the mould plate which extend through the matrix material thereon, the pins serving to form apertures in the said material.

Whilst the matrix material will ordinarily comprise a polyamide or polyester material provided in particulate or other form, it may be found convenient in some instances to utilise a radiation curable resin, permeability of the matrix being effected by selective polymerisation of the resin through a mask having transparent and opaque regions thereto, polymerisation occurring in register with the transparent regions and resin in positions in register with the opaque regions being removed subsequent to the polymerisation step to leave an aperture thereat.

BRIEF DESCRIPTION OF THE DRAWINGS

The invention will now be described further, by way of example only, with reference to the accompanying diagrammatic drawings illustrating several embodiments thereof and in which.

DETAILED DESCRIPTION OF THE PREFERRED EMBODIMENTS

Figure 1:
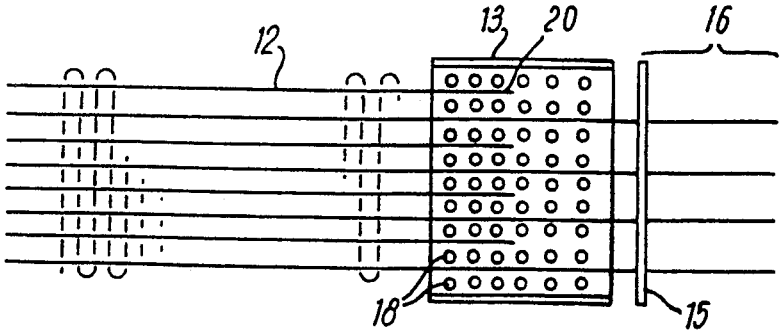
FIG. 1 is a diagrammatic plan view illustrating a first embodiment of the method of the invention as applied to a woven structure.

Referring now to the drawings, and in particular to FIGS. 1 to 5 thereof, a seam is formed at the end of a woven structure 11 by fringing out the warp yarns 12, cutting back, say, alternate warp yarns, laying the yarns in side-by-side disposition across and in engagement with a pinned plate 13, the intermediate "fringed-out" warp yarns being of a length to protrude beyond the plate 13 by an amount 16 sufficient to form the required loops 14, and, after folding about a pin 15 extending in the transverse direction of the plate and in closely spaced disposition outwardly of the free edge thereof, to provide for further substantial engagement with the plate. Location of the monofilament yarns in spaced apart disposition relative to the floor of the mould plate, thereby to ensure that matrix material will exist below such yarns, may be effected by forming shoulders on the pins and on which the monofilament yarns are supported.

Figure 4:
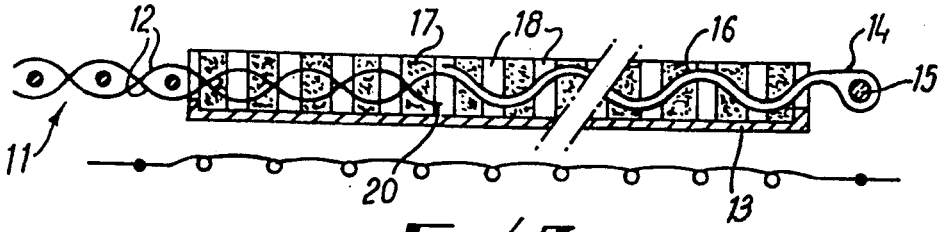
FIG. 4 illustrates the application of a matrix material and the heating thereof to form, after cooling, a coherent body within which the warp yarns are embedded.

A thermoplastics matrix material 17, for example in particulate form, is applied to the plate 13 in an amount sufficient to fill the same to the level of the side walls thereof, such material, on the application of heat, via suitable heater means shown below the mould plate in FIG. 4, and the subsequent cooling thereof, imparting a requisite degree of integrity in the resultant seam by encapsulation of the warp yarns 12 engaged with the plate 13 within the matrix material. The pins 18 upstanding from the plate are of a length to extend to the upper edge of the side walls of the mould plate, and thus define through apertures 19 in the end region of the fabric which are consistent with the interstices in the body of the woven fabric, thereby to give a like permeability characteristic to such end region to that of the remainder of the fabric.

Figure 3:
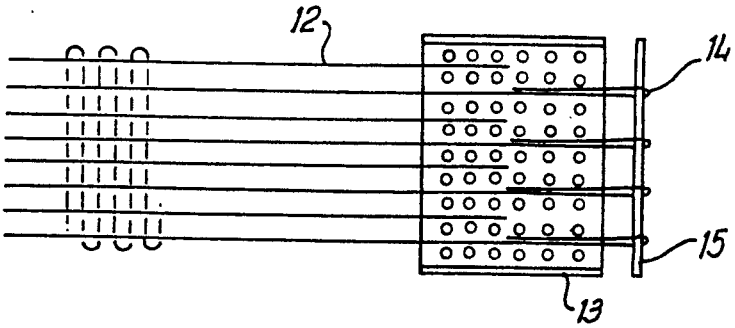
FIG. 3 is a view corresponding to FIG. 1 and shows a later stage in the method.

As is apparent from FIG. 3 of the drawings, the warp yarns intermediate the loop forming yarns terminate short of the remote edge of the mould plate 13, as shown at 20, whilst the ends of the loop-forming yarns are folded back on themselves, the crimp inherent in the yarn being arranged so that portions thereof lying in superimposed disposition exist in nested relationship as shown in the drawings. The height of the side walls of the mould plate, and thus the thickness of the matrix material, will closely approximate to the fabric thickness, as is necessary in relation to papermachine clothing where avoidance of seam marking of the paper produced thereon is of paramount importance.

In a development of the method described with reference to FIGS. 1 to 5, a cast is made of the fabric surface profile and pins are provided in such cast in register with the interstices in the fabric, the cast then being used in lieu of the mould plate, such a course providing a reproduction of the fabric profile in the region of the fabric end.

In a further modification, and particularly in the case of a multiply fabric, for example a duplex-fabric, a proportion, say three out of four, of the warpwise extending yarns are cut back close to the leading edge of the mould plate, the remaining yarns extending across the mould plate and being utilised in the manner above set forth in forming loops. In the event that the cut-back yarns extend across the mould, such ends may be shifted laterally to improve the security of their attachment to the matrix material.

The facility for controlling fabric permeability at the fabric end by variation in pin size and distribution is of importance, in that the inherent permeability of the body of the fabric can be reproduced by appropriate selection of these parameters.

Figure 6:
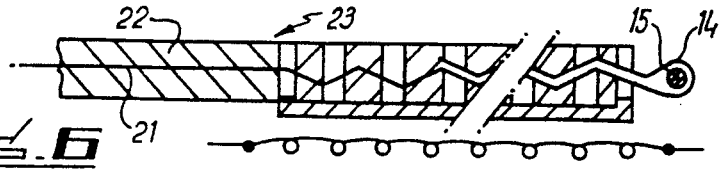
FIG. 6 is a view corresponding to FIG. 4, and shows the invention as applied to the context of a non-woven structure having monofilament yarn reinforcement.
Figure 7:
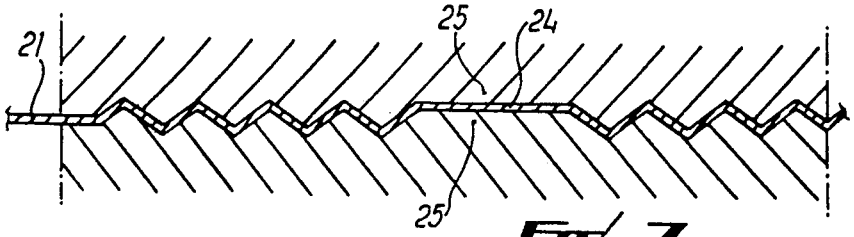
FIG. 7 is a diagrammatic illustration of a means for introducing crimp into the free end of the substantially straight monofilament reinforcement of the fabric shown in FIG. 6.

The method as illustrated by FIGS. 1 to 5 is susceptible to ready modification for use in the context of a composite fabric of the kind disclosed in EP-A-0285376. Referring to FIGS. 6 and 7 in which like reference numerals to those used previously are used for the same or similar parts, artificial crimp is introduced into the straight warp reinforcing yarns 21 extending outwardly from the matrix material 22 of the body of the fabric 23, say in accordance with FIG. 7, the non-crimped region 24 of the monofilament yarn shown therein and existing between mould parts 25 being of a length such as will form a loop 14 of a requisite size on folding of the monofilament about rod 15.

The encapsulation procedure is generally in accordance with the method of FIGS. 1 to 5 and further description is thought unnecessary.

Figure 8:
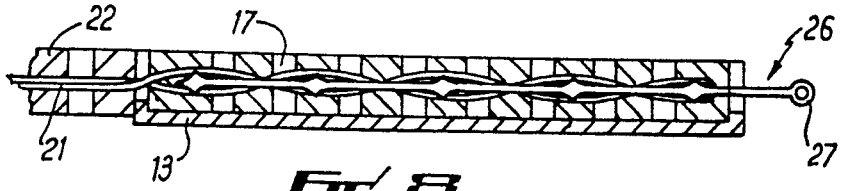
FIG. 8 is a view corresponding to FIG. 6, and illustrates the use of a preformed jointing means.
Figure 9:
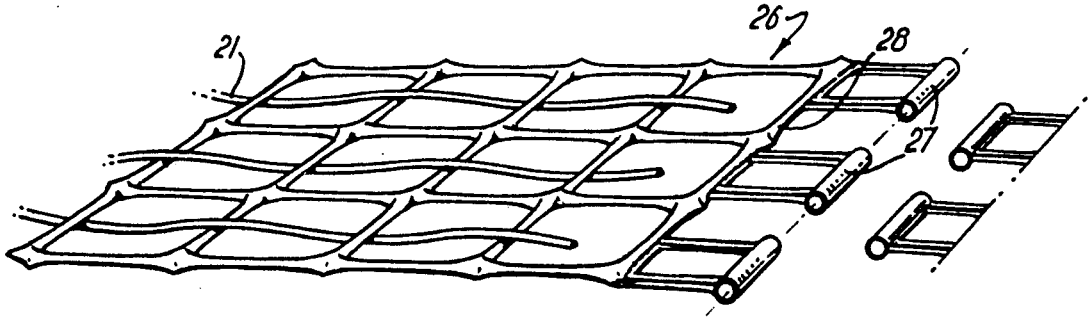
FIG. 9 is a perspective view of the pre-formed jointing means of the arrangement shown in FIG. 8.

In a still further modification of the method, see now FIGS. 8 and 9, in which like reference numerals to those of the previous figures are used for the same or similar parts, a premoulded seam element comprising an open, reticulate web member 26 having axially aligned tunnels 27 provided along a remote longitudinal edge 28 thereof is utilised, the web member 26 being applied to the pinned plate 13 for cooperation with those monofilament yarns 21 extending from the end of a composite fabric which are engaged therewith, the web member 26 and yarns 21 being encapsulated in matrix material 17 in analogous manner to the previous proposals.

In this instance the monofilament warp yarns 21 do not extend beyond the remote edge of the mould plate 13, and, as can be seen from the drawings, such warp yarns 21 may, if preferred, be interlaced with the web member 26, the interlacing serving to provide an improved load-bearing connection between the yarns 21 and web member 26 on encapsulation and the crimp resisting any tendency of the monofilament to be pulled from the matrix in the use condition of the fabric. It may be found sufficient, however, merely to arrange the yarns and seam element in relatively overlying disposition, rather than to effect interlacing therebetween.

Figure 5:
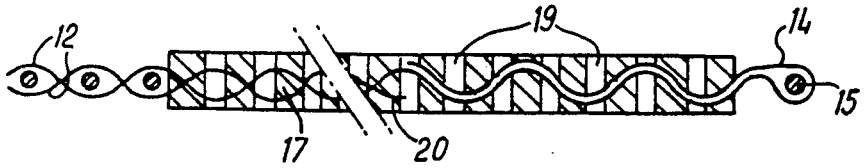
FIG. 5 is a side elevation of a fabric end having loops provided thereon and corresponds to FIG. 4.

As with the embodiment of FIG. 5, so too in this instance is the matrix applied to the mould plate at a thickness to correspond to that of the body of the fabric.

In a still further alternative to the procedures hereinbefore described, it is also proposed to use an apertured hinge-like element which is positioned in register with the pinned mould plate, the hinge-like element being encapsulated in matrix material in analogous manner to the premoulded seam element of the embodiment shown in FIGS. 8 and 9. As with the embodiment of FIGS. 8 and 9, so too in this instance are the warp yarns and hinge-like element arranged in overlying disposition. In a modification, the web portion of the hinge-like element may be of multiplyconfiguration, the adjacent faces of successive plies being profiled to receive the warp yarns into engagement therewith and retention means being provided, if required, to clamp the plies together and thereby secure the yarns to the hinge-like element.

Figure 2:
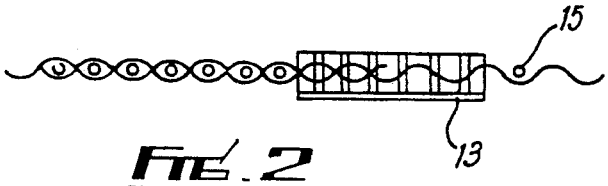
FIG. 2 is a side elevation of the arrangement shown in FIG. 1.

The invention is not restricted to the detail of the methods hereinbefore set forth, since alternatives will readily present themselves to one skilled in the art. Thus, whilst in the case of the method disclosed in relation to FIGS. 1 to 4 of the drawings, whilst it is thought desirable to arrange that the crimp of the turned back yarn is such as to permit of the nesting relationship shown, it is not essential that such relationship exist within the matrix material. Furthermore, folding back a free warp end along the line of the yarn, as shown in FIG. 2, is not essential, and, if preferred, a turned back yarn may be folded into alignment and abutting end-to-end relationship with, say the next adjacent cut-back yarn.

Other possible modifications include turning the remote end of the folded-back, loop forming monofilament yarn laterally across the plate and/or heating the extremity of that yarn to form a mushroom thereat, the lateral displacement and deformation both serving to enhance retention within the matrix material.

The position at which yarns are cut back, or indeed to which loop-forming yarns are folded-back, may be staggered in the yarn direction.

Whilst the invention is disclosed in the context of the use of matrix material in particulate form, such material may be provided in liquid form or indeed as a sheet of such material which is brought into its liquid form by application of heat. Other possibilities include the use of sheathed or encapsulated yarns of which the sheath or encapsulation material is capable of being brought into fluent form for fusion with that of adjacent yarns, whether of like form or otherwise.

In a further possibility, the end region of a fabric produced in accordance with the teaching of EP-A-0285376 is treated to remove the matrix material and thereby expose warpwise extending yarns which are brought into loop form in analogous manner to the method illustrated by, say, FIGS. 6 and 7.

The matrix material may be selected from among the full spectrum of flexible polymeric compounds without regard to any yarn forming capacity thereof. Typical materials are polyesters, such as polyethylene terephthalate, polyamides, for example nylon, polyethylene and polyurethane, the matrix material having a melting point lower than that of the yarn to be embedded therein. In some circumstances silicone rubber may be useful as a matrix material.

Other suitable matrix materials include thermosetting plastics materials, resinous materials which are water-reactive, radiation curable resins, and reaction moulding compounds which polymerise almost immediately on being mixed together.

The primary application of the invention is in the context of papermakers fabrics and like industrial fabrics, such as those used in the board-making and asbestos cement sheet-making industries, although the invention may well be of application in other fields and the disclosure hereof is to be construed accordingly.

We claim:

1. In the production of an endless fabric band the method of providing a jointing means at a fabric end for cooperative engagement with a complementary jointing means at another fabric end in effecting a seam between said ends, said fabric ends including monofilament yarns extending in the movement direction of the endless band, the method comprising the steps of providing protruding side-by-side free yarn ends extending in said movement direction at said fabric end, locating said protruding yarn ends in overlying disposition relative to a mould plate, providing a loop-forming material to overlie the mould plate and to extend outwardly therefrom at that side thereof remote from the fabric thereat to define loops, introducing fluent matrix material to the region of the plate, heating said matrix material to cause said material to melt and embed the free yarn ends and loop forming material therein, creating apertures in said matrix material by the mould plate and thereby providing a comparable permeability to that of the fabric, and subsequently cooling said matrix material and secure the free yarn ends and loop forming material within the matrix material.

2. The method as claimed in claim 1, including the step of providing upstanding pins to the mould plate which extend through the matrix material thereon, the pins serving to form apertures in the said material.

3. In the production of an endless fabric band the method of providing a jointing means at a fabric end for cooperative engagement with a complementary jointing means at another fabric end in effecting a seam between said ends, said fabric ends including monofilament yarns extending in the movement direction of the endless band, the method comprising the steps of providing protruding side-by-side free yarn ends extending in said movement direction at said fabric end, locating said protruding yarn ends in overlying disposition relative to a mould plate, providing a loop-forming material to overlie the mould plate and to extend outwardly therefrom at that side thereof remote from the fabric thereat to define loops, introducing fluid matrix material to the region of the plate, effecting polymerization of said matrix and thereby embed the free yarn ends and loop forming material therein, creating apertures in the matrix material, to provide a comparable permeability to the permeability of the fabric, and providing a mask intermediate the matrix material and a source of radiation and effecting said polymerisation of the matrix material through said mask, said mask having transparent and opaque regions thereto, polymerisation occurring in register with the transparent regions and non-polymerised matrix material in positions in register with the opaque regions being removed subsequent to the polymerisation step to leave respective apertures thereat.

4. The method as claimed in claim 3, wherein the matrix material comprises a radiation curable polymeric resin.

5. In the production of an endless fabric band the method of providing a jointing means at a fabric end for cooperative engagement with a complementary jointing means at another fabric end in effecting a seam between said ends, said fabric ends including monofilament yarns extending in the movement direction of the endless band, the method comprising the steps of providing protruding side-by-side free yarn ends extending in said movement direction at said fabric end, locating said protruding yarn ends in overlying disposition relative to a mould plate, providing a loop-forming material to overlie the mould plate and to extend outwardly therefrom at that side thereof remote from the body of the fabric thereat to define loops, introducing fluent radiation curable polymeric resin to the region of the plate, creating apertures in the radiation curable polymeric resin, to provide a permeability comparable to that of the fabric by providing a mask intermediate the resin and a source of radiation and effecting selective polymerization of the resin through said mask, said mask having transparent and opaque regions thereto, polymerization occurring in register with the transparent regions, and resin in positions in register with the opaque regions being removed subsequent to the polymerization step to leave respective apertures thereat.

* * * * *